US012371869B2

(12) United States Patent
Wang et al.

(10) Patent No.: US 12,371,869 B2
(45) Date of Patent: Jul. 29, 2025

(54) GROUTING PIPE WITH VIBRATION FUNCTION

(71) Applicant: SAFEKEY Engineering Technology (Zhengzhou), Ltd., Henan (CN)

(72) Inventors: Fuming Wang, Henan (CN); Xiaolong Li, Henan (CN); Yanhui Zhong, Henan (CN); Bei Zhang, Henan (CN); Yongli Chen, Henan (CN); Xianfeng Zhao, Henan (CN)

(73) Assignee: SAFEKEY Engineering Technology (Zhengzhou), Ltd., Henan (CN)

( * ) Notice: Subject to any disclaimer, the term of this patent is extended or adjusted under 35 U.S.C. 154(b) by 187 days.

(21) Appl. No.: 18/144,210

(22) Filed: May 7, 2023

(65) Prior Publication Data

US 2023/0313484 A1 Oct. 5, 2023

(30) Foreign Application Priority Data

Feb. 6, 2023 (CN) ..... 202310067880.3

(51) Int. Cl.
*E02D 15/04* (2006.01)
*E02D 3/12* (2006.01)
*E02D 15/02* (2006.01)

(52) U.S. Cl.
CPC ..... *E02D 15/04* (2013.01); *E02D 3/12* (2013.01); *E02D 15/02* (2013.01); *E02D 2250/003* (2013.01)

(58) Field of Classification Search
CPC ..... E02D 3/12; E02D 3/123; E02D 15/02; E02D 15/04; E02D 2250/003
USPC ..... 405/258.1, 266, 269
See application file for complete search history.

(56) References Cited

U.S. PATENT DOCUMENTS 5,029,645 A * 7/1991 Allen ..... B28C 5/48 405/269
5,123,782 A * 6/1992 Yoshida ..... E02D 3/054 405/269
7,891,440 B2 * 2/2011 Roussy ..... E02D 3/12 175/57
8,074,740 B2 * 12/2011 Roussy ..... E02D 3/12 175/171
2002/0020528 A1 * 2/2002 McCabe ..... E02D 3/12 405/269

FOREIGN PATENT DOCUMENTS

CN 111364441 A * 7/2020 ..... E02D 3/12
CN 113309069 A * 8/2021 ..... E02D 3/08
(Continued)

*Primary Examiner* — Frederick L Lagman

(57) ABSTRACT

A grouting pipe with a vibration function includes: a grouting pipe body provided with a hydraulic control structure, a vibration structure and a grouting hole control structure; wherein the vibration structure is rotatably arranged inside the grouting pipe body, and the hydraulic control structure is provided outside the grouting pipe body; the grouting hole control structure is provided on an internal wall of the grouting pipe body, and the hydraulic control structure is connected to the grouting hole control structure through a first hydraulic pipe. The grouting pipe solves the technical problems that conventional grouting pipes may be blocked by sandy soil during a press-in process, and it is difficult for the slurry to diffuse.

6 Claims, 4 Drawing Sheets

(56) References Cited

FOREIGN PATENT DOCUMENTS

| | | | | |
|---|---|---|---|---|
| KR | 101503259 | B1 | * | 3/2015 |
| KR | 101546472 | B1 | * | 8/2015 |
| KR | 101760218 | B1 | * | 7/2017 |
| KR | 101818200 | B1 | * | 1/2018 |

* cited by examiner

GROUTING PIPE WITH VIBRATION FUNCTION

CROSS REFERENCE OF RELATED APPLICATION

The present invention claims priority under 35 U.S.C. 119(a-d) to CN 202310067880.3, filed Feb. 6, 2023.

BACKGROUND OF THE PRESENT INVENTION

Field of Invention

The present invention relates to technical field of grouting reinforcement and repair for geotechnical engineering, and more particularly to a grouting pipe with a vibration function.

Description of Related Arts

Grouting reinforcement can improve the integrity and strength of the rock or soil by injecting slurry into the rock or soil through drilled holes. For the grouting at water-rich sand layers, the conventional grouting pipe is often blocked by sandy soil during press-in process, and the slurry tends to overflow along the external wall of the grouting pipe during grouting. Therefore, it is urgent to propose a grouting pipe with a vibration function, which vibrates when injecting slurry into the saturated sand layer to "liquefy" the sand layer structure and expand the range of slurry diffusion, thereby preventing the grouting pipe from being blocked by the sandy soil during the press-in process and preventing the slurry from overflowing along the external wall of the grouting pipe.

SUMMARY OF THE PRESENT INVENTION

An object of the present invention is to provide a grouting pipe with a vibration function, so as to solve the technical problems that conventional grouting pipes may be blocked by sandy soil during a press-in process, and it is difficult for the slurry to diffuse.

Accordingly, in order to accomplish the above object, the present invention provides a grouting pipe with a vibration function, comprising: a grouting pipe body provided with a hydraulic control structure, a vibration structure and a grouting hole control structure; wherein the vibration structure is rotatably arranged inside the grouting pipe body, and the hydraulic control structure is provided outside the grouting pipe body; the grouting hole control structure is provided on an internal wall of the grouting pipe body, and the hydraulic control structure is connected to the grouting hole control structure through a hydraulic pipe.

Preferably, the grouting pipe body comprises a first grouting pipe body and a second grouting pipe body; the first grouting pipe body is connected to the second grouting pipe body by a vibration damping member.

Preferably, a slurry stopper is sleeved on the first grouting pipe body, which is connected to a liquid delivery pump through a liquid delivery pipe.

Preferably, the hydraulic control structure is provided on the first grouting pipe body, and comprises a hydraulic pump, a reservoir, a control valve and a valve stem; the hydraulic pump and the reservoir are connected to the control valve through the hydraulic pipe; the control valve is connected to the grouting hole control structure through the hydraulic pipe; the valve stem moves left and right in the control valve.

Preferably, the vibration structure is provided inside the second grouting pipe body, and comprises a drive shaft, a first connection member, a rotating shaft and a second connection member connected in sequence; the drive shaft passes through the first grouting pipe body and is connected to an electric motor; the first connection member and the second connection member are rotatably connected to an internal wall of the second grouting pipe body.

Preferably, the first connection member comprises a first support member and a first bearing; the first support member has a hollow structure, and is fixedly connected to the internal wall of the second grouting pipe body; the first bearing is rotatably connected to the first support member.

Preferably, an eccentric block is fixed on an external wall of the rotating shaft.

Preferably, the grouting hole control structure is provided inside the second grouting pipe body, and comprises a hydraulic lever, a grouting hole valve, a hydraulic cylinder and multiple grouting holes; the grouting hole valve is connected to the hydraulic lever; the hydraulic lever is located inside the hydraulic cylinder; the hydraulic cylinder is connected to the hydraulic control structure through the hydraulic pipe; and the multiple grouting holes are provided on the grouting hole valve.

Preferably, a slurry delivery structure is provided inside the grouting pipe body, and comprises a main slurry pipe, a distributor and multiple slave slurry pipes; the main slurry pipe is connected to an external grouting device, and the multiple slave slurry pipes are connected to the multiple grouting holes on the grouting hole valve, respectively.

Preferably, an end of the second grouting pipe body, which is away from the first grouting pipe body, is conical.

According to the above technical solution of the present invention, the grouting pipe comprises: a grouting pipe body provided with a hydraulic control structure, a vibration structure and a grouting hole control structure; wherein the vibration structure is rotatably arranged inside the grouting pipe body, and the hydraulic control structure is provided outside the grouting pipe body; the grouting hole control structure is provided on an internal wall of the grouting pipe body, and the hydraulic control structure is connected to the grouting hole control structure through a first hydraulic pipe. According to the present invention, the vibration structure vibrates during a grouting process to "liquefy" a sand layer structure, thus expanding a diffusion range of the slurry in the sand layer. With the grouting hole control structure, opening and closing of the grouting hole valve is regulated in real time to effectively prevent the grouting pipe from being blocked by sandy soil during the press-in process, which solves the technical problems that the conventional grouting pipes may be blocked by sandy soil during the press-in process, and it is difficult for the slurry to diffuse.

According to the present invention, a slurry stopper is sleeved on the grouting pipe body, which effectively prevent the slurry from overflowing along the external wall of the grouting pipe during grouting.

BRIEF DESCRIPTION OF THE DRAWINGS

In order to more clearly illustrate the technical solutions in embodiment of the present invention or prior art, the following is a brief description of accompanying drawings used for describing the embodiment or prior art. It is obvious that the accompanying drawings described below are only some of the embodiments of the present invention, and it is also possible for a person of ordinary skill in the art to obtain, without creative work, other related drawings based on the structures illustrated in the accompanying drawings.

ELEMENT REFERENCES

Figure 1:
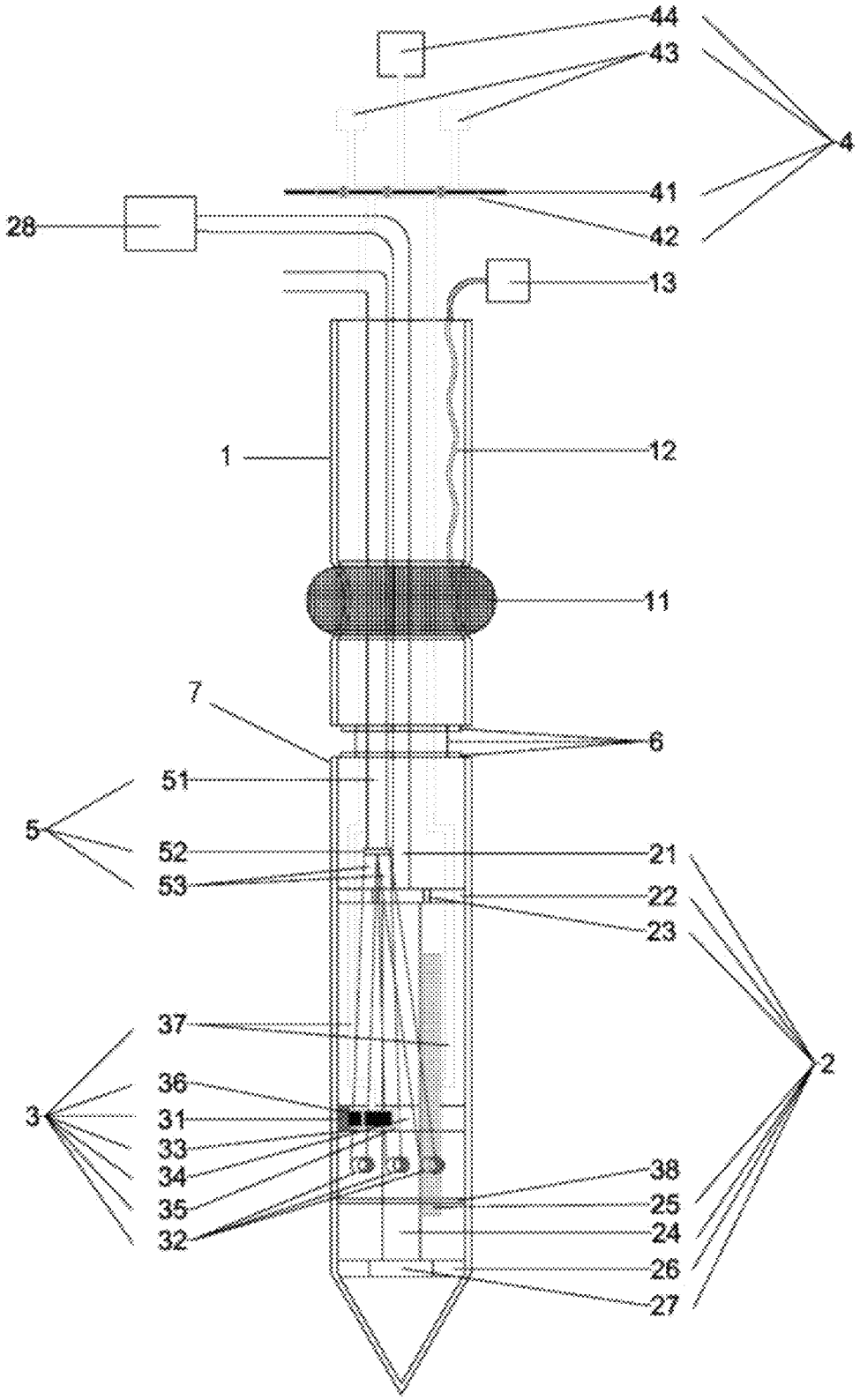
FIG. 1 is a first structural view of a grouting pipe with a vibration function according to an embodiment of the present invention.
Figure 2:
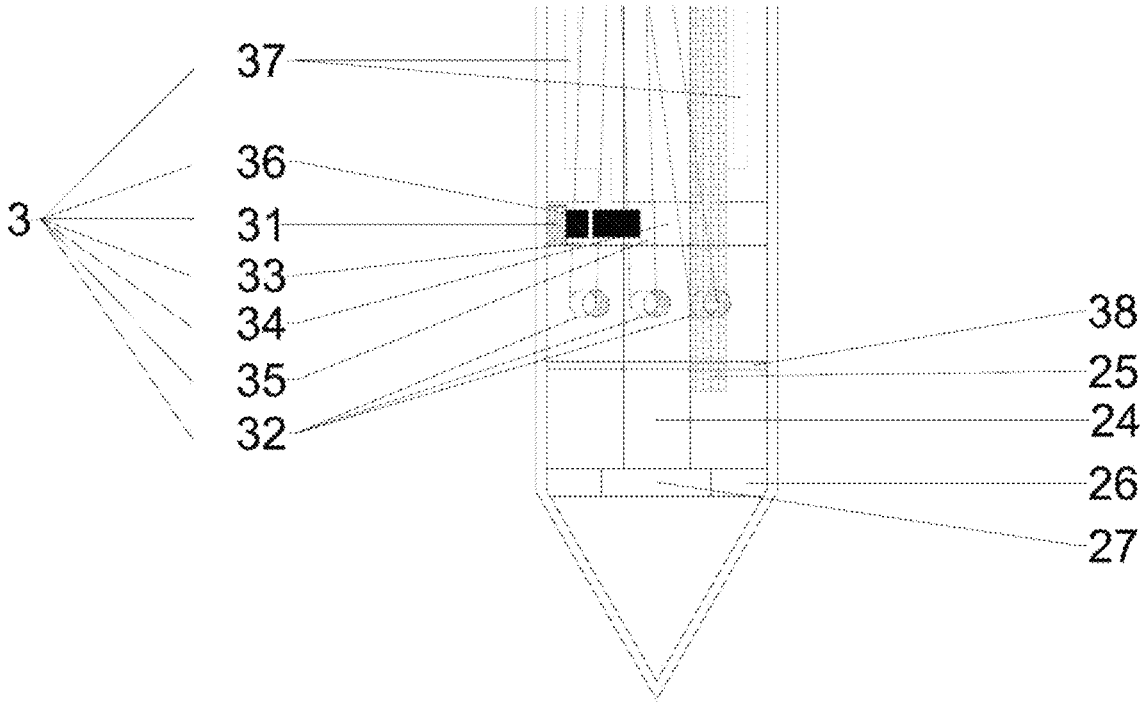
FIG. 2 is a second structural view of the grouting pipe with the vibration function according to the embodiment of the present invention.
Figure 3:
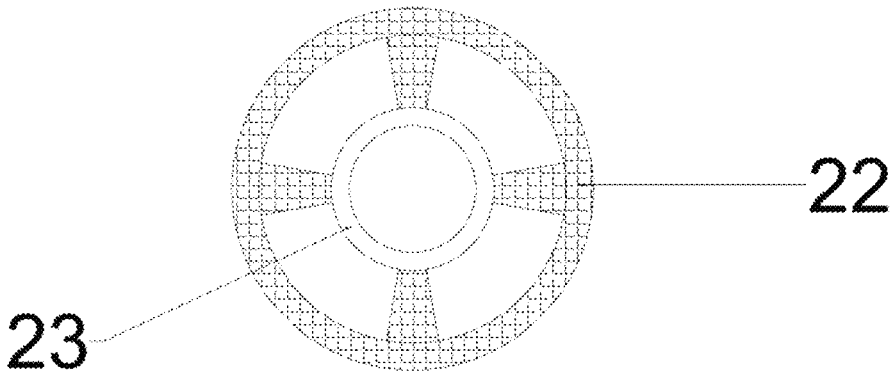
FIG. 3 is a structural view of a first connection member according to the embodiment of the present invention.
Figure 4:
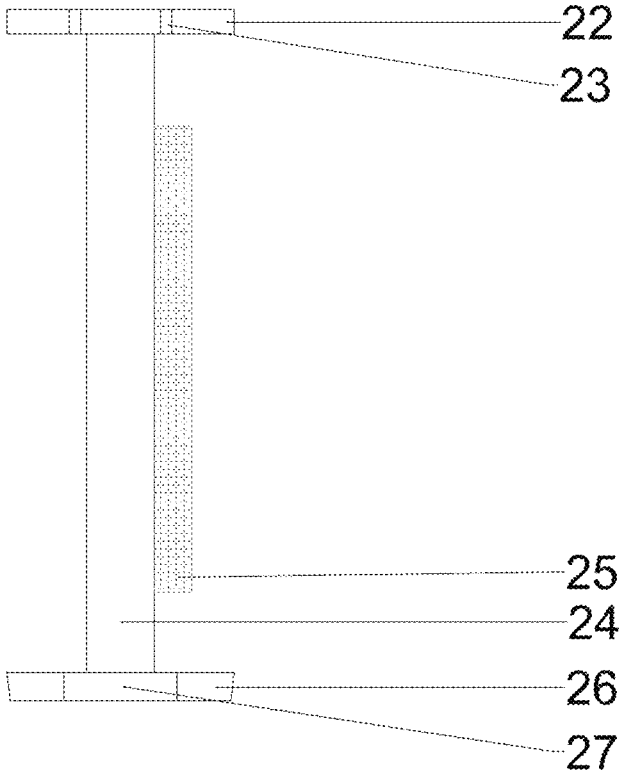
FIG. 4 is a structural view of a vibration structure according to the embodiment of the present invention.
Figure 5:
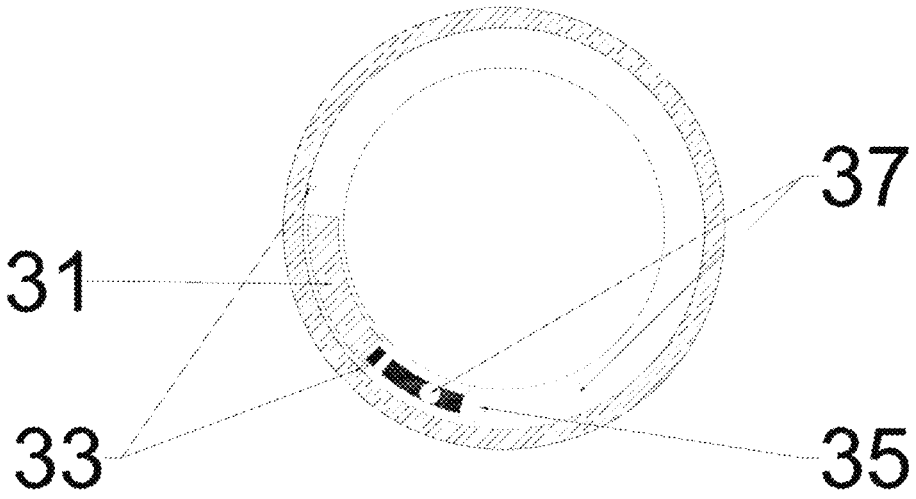
FIG. 5 is a cross-sectional view of a grouting hole control structure according to the embodiment of the present invention.
Figure 6:
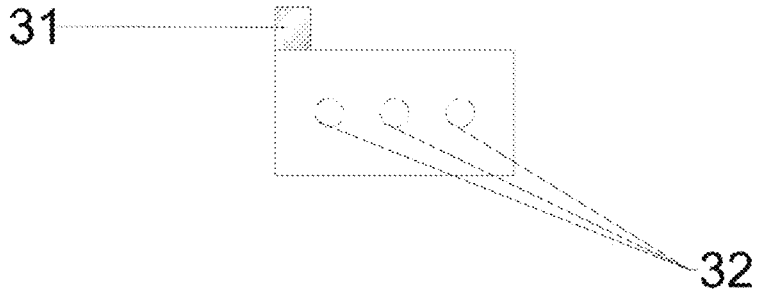
FIG. 6 is a structural view of a grouting hole valve according to the embodiment of the present invention.
Figure 7:
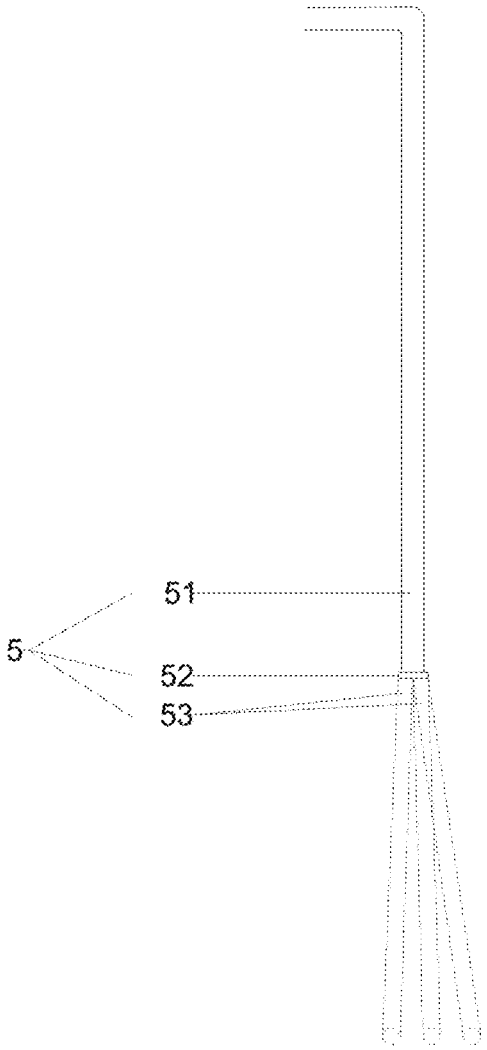
FIG. 7 is a structural view of a liquid delivery structure according to the embodiment of the present invention.

1—first grouting pipe body; 11—slurry stopper; 12—liquid delivery pipe; 13—liquid delivery pump;

2—vibration structure; 21—drive shaft; 22—first support member; 23—first bearing; 24—rotating shaft; 25—eccentric block; 26—second support member; 27—second bearing;

3—grouting hole control structure; 31—grouting hole valve; 32—grouting hole; 33—limit block; 34—hydraulic cylinder; 35—sealing ring; 36—hydraulic lever; 37—hydraulic pipe; 38—annular base;

4—hydraulic control structure; 41—valve stem; 42—control valve; 43—reservoir; 44—hydraulic pump;

5—slurry delivery structure; 51—main slurry pipe; 52—distributor; 53—slave slurry pipe;

6—vibration damping member;

7—second grouting pipe body.

Implementation, functional features and advantages of the present invention will be further described in conjunction with the drawings and the embodiment.

DETAILED DESCRIPTION OF THE PREFERRED EMBODIMENT

The technical solutions in the embodiments of the present invention will be clearly and completely described below in conjunction with the accompanying drawings of the embodiment of the present invention. It is clear that the embodiment described is only a part of all embodiments of the present invention. Based on the embodiment described, all other embodiments obtained by a person of ordinary skill in the art without creative work shall fall within the protection scope of the present invention.

It should be noted that all directional indications (such as up and down . . . ) in the embodiment of the present invention are used only to explain the relative position relationship, movement, etc., between the components in a particular attitude (as shown in the drawings). If that particular attitude is changed, the directional indications change accordingly.

Furthermore, descriptions such as "first" and "second" in the present invention are descriptive only and are not indicating or implying their relative importance or implicitly specifying the quantity of technical features indicated. Thus, features qualified with "first" and "second" may explicitly or implicitly include at least one such feature.

Moreover, the technical solutions between various embodiments of the present invention may be combined with each other, but only on the basis that they can be realized by a person of ordinary skill in the art. When the combination of technical solutions appears to contradict each other or cannot be realized, it shall be considered that such combination of technical solutions does not exist and is not within the protection scope of the present invention.

Referring to FIG. 1 of the drawings, in one aspect, the present invention provides a grouting pipe with a vibration function, comprising: a grouting pipe body provided with a hydraulic control structure 4, a vibration structure 2 and a grouting hole control structure 3; wherein the vibration structure 2 is rotatably arranged inside the grouting pipe body, and the hydraulic control structure 4 is provided outside the grouting pipe body; the grouting hole control structure 3 is provided on an internal wall of the grouting pipe body, and the hydraulic control structure 4 is connected to the grouting hole control structure 3 through a hydraulic pipe 37.

Specifically, according to the embodiment, the grouting pipe body comprises a first grouting pipe body 1 and a second grouting pipe body 7; the first grouting pipe body 1 is connected to the second grouting pipe body 7 by a vibration damping member 6. The first grouting pipe body 1 and the second grouting pipe body 7 are made of steel material, and the vibration damping member 6 is a rubber damper. The first grouting pipe body 1 is connected to the second grouting pipe body 7 by the rubber damper, in such a manner that the vibration generated by the vibration structure 2 inside the second grouting pipe from will not be transmitted to the whole grouting pipe. At the same time, the vibration damping member 6 separates the grouting pipe body into the first grouting pipe body 1 and second grouting pipe body 7, which can enhance a local vibration effect of the second grouting pipe body 7.

Specifically, according to the embodiment, a slurry stopper 11 is sleeved on the first grouting pipe body 1, which is connected to a liquid delivery pump 13 through a liquid delivery pipe 12. The first grouting pipe body 1 has a concave part, and the slurry stopper 11 is sheathed on the concave part. A connection hole is drilling at the concave part, the liquid delivery pipe 12 is connected to the slurry stopper 11 through the connection hole, and the other end of the liquid delivery pipe 12 is connected to the liquid delivery pump 13. Before pressing the grouting pipe into the sand layer structure, liquid in the slurry stopper 11 is pumped out through the liquid delivery pump 13, so that the slurry stopper 11 is contain in the concave part of the first grouting pipe body 1. After pressing the grouting pipe into a designated position of the sand layer structure, liquid is injected into the slurry stopper 11 through the liquid delivery pump 13 before grouting, so that the slurry stopper 11 is completely expanded to prevent the slurry from overflowing along the external wall of the grouting pipe during grouting.

Specifically, according to the embodiment, the hydraulic control structure 4 is provided on the first grouting pipe body 1, and comprises a hydraulic pump 44, a reservoir 43, a control valve 42 and a valve stem 41; the hydraulic pump 44 and the reservoir 43 are connected to the control valve 42 through the hydraulic pipe 37; the control valve 42 is connected to the grouting hole control structure 3 through the hydraulic pipe 37; the valve stem 41 moves left and right in the control valve 42. If the valve stem 41 is moved to the leftmost side of control valve 42, the hydraulic pipe 37 is pressurized through the hydraulic pump 44, so that liquid pushes a hydraulic lever 36 to rotate clockwise by a certain angle in the hydraulic cylinder 34. As a result, the multiple grouting holes 32 on the grouting hole valve 31 do not overlap with ports of the slave slurry pipe 53. If the valve stem 41 is moved to the rightmost side of the control valve 42, the hydraulic pipe 37 is pressurized through the hydraulic pump 44, so that the liquid pushes the hydraulic lever 36 to rotate counterclockwise by a certain angle in the hydraulic cylinder 34. As a result, the multiple grouting holes 32 on the grouting hole valve 31 overlap with the ports of the slave slurry pipe 53 for grouting.

Specifically, according to the embodiment, the vibration structure 2 is provided inside the second grouting pipe body 7, and comprises a drive shaft 21, a first connection member, a rotating shaft 24 and a second connection member connected in sequence; the drive shaft 21 passes through the first grouting pipe body 1 and is connected to an electric motor; the first connection member and the second connection member are rotatably connected to an internal wall of the second grouting pipe body 7. The first connection member comprises a first support member 22 and a first bearing 23, wherein the first support member 22 has a hollow structure, and is fixedly connected to the internal wall of the second grouting pipe body 7. The first bearing 23 is rotatably connected to the first support member 22. The drive shaft 21 is a drive flexible shaft, and is connected to the first bearing 23, thereby driving the first bearing 23 through the drive flexible shaft. The second connection member comprises a second support member 26 and a second bearing 27, wherein the second support member 26 is fixedly connected to the internal wall of the second grouting pipe body 7. The second bearing 27 is rotatably connected to the second support member 26, and is connected to one end of the rotating shaft 24. The other end of the rotating shaft 24 is connected to the first bearing 23. An eccentric block 25 is fixed on an external wall of the rotating shaft 24, wherein the vibration is provided by a centrifugal force generated by rapid rotation of the rotating shaft 24 and the eccentric block 25.

Specifically, according to the embodiment, the grouting hole control structure 3 is provided inside the second grouting pipe body 7, and comprises a hydraulic lever 36, a grouting hole valve 31, a hydraulic cylinder 34 and multiple grouting holes 32; the grouting hole valve 31 is connected to the hydraulic lever 36; the hydraulic lever 36 is located inside the hydraulic cylinder 34; the hydraulic cylinder 34 is connected to the hydraulic control structure 4 through the hydraulic pipe 37; and the multiple grouting holes 32 are provided on the grouting hole valve 31. A sealing ring 35 is provided at one end of the grouting hole valve 31 for closely contacting, so as to prevent air and liquid leakage, and at the same time provide pressure-relief, anti-vibration and anti-loosening effects. One end of the hydraulic pipe 37 is connected to the control valve 42 of the hydraulic control structure 4, and the other end of the hydraulic pipe 37 is connected to the hydraulic cylinder 34 of the grouting hole control structure 3. In the present invention, there are two hydraulic pipes 37, which are not specifically limited herein and can be configured according to the needs. An annular base 38 is arranged at a bottom end of the grouting hole control structure 3, which is fixedly connected to the interior of the second grout pipe body 7 to support the grouting hole valve 31. A groove is arranged at a contact surface between the annular base 38 and the grouting hole valve 31, and steel balls are provided in the groove.

Specifically, according to the embodiment, a limit block 33 is provided on the internal wall of the second grouting pipe body 7 to limit a rotation angle of the grouting hole valve 31.

Specifically, according to the embodiment, a slurry delivery structure 5 is provided inside the grouting pipe body, and comprises a main slurry pipe 51, a distributor 52 and multiple slave slurry pipes 53; the main slurry pipe 51 is connected to an external grouting device, and the multiple slave slurry pipes 53 are connected to the multiple grouting holes 32 on the grouting hole valve 31, respectively. The multiple slave slurry pipes 53 pass through the hollowed first support member 22 and are correspondingly connected to the multiple grouting holes 32 on the grouting hole valve 31. The size of the distributor 52 is determined according to the quantity of the grouting holes 32, and will not be specifically limited by the present invention. In the present invention, the slurry delivery structure 5 has three slave slurry pipes 53, and the grouting valve 31 has three grouting holes 32 compatible with the slave slurry pipes 53, which are not specifically limited herein and can be configured according to the needs. A diameter of the grouting holes 32 on the grouting hole valve 31 is identical to a diameter of the ports of the slave slurry pipes 53.

Specifically, according to the embodiment, an end of the second grouting pipe body 7, which is away from the first grouting pipe body 1, is conical.

Specifically, according to the embodiment, before pressing the grouting pipe into the sand layer structure, the liquid in the slurry stopper 11 is pumped out through the liquid delivery pump 13, so that the slurry stopper 11 is contain in the concave part of the first grouting pipe body 1. At the same time, the valve stem 41 is moved to the leftmost side of control valve 42, the hydraulic pipe 37 is pressurized through the hydraulic pump 44, so that liquid pushes a hydraulic lever 36 to rotate clockwise by a certain angle in the hydraulic cylinder 34. As a result, the hydraulic lever 36 drives the grouting hole valve 31 to rotate clockwise until the multiple grouting holes 32 on the grouting hole valve 31 do not overlap with the ports of the slave slurry pipe 53. After pressing the grouting pipe into a designated position of the sand layer structure, liquid is injected into the slurry stopper 11 through the liquid delivery pump 13 before grouting, so that the slurry stopper 11 is completely expanded. At the same time, the valve stem 41 is moved to the rightmost side of the control valve 42, the hydraulic pipe 37 is pressurized through the hydraulic pump 44, so that the liquid pushes the hydraulic lever 36 to rotate counterclockwise by a certain angle in the hydraulic cylinder 34. As a result, the hydraulic lever 36 drives the grouting hole valve 31 to rotate counterclockwise until the multiple grouting holes 32 on the grouting hole valve 31 overlap with the ports of the slave slurry pipe 53. Then the electric motor is turned on to drive the drive shaft 21, so as to rotate the rotating shaft 24. Eccentric motion of the eccentric block 25 fixed on the rotating shaft 24 can generate vibration.

Specifically, according to the embodiment, the slurry from the external grouting device passes through the main grouting pipe 51 and the distributor 52, and enters the multiple slave slurry pipes 53. The multiple slave slurry pipes 53 pass through the hollowed first support member 22 and are connected to the grouting hole valve 31. After grouting, the liquid in the slurry stopper 11 is pumped out so that the stopper 11 is contained in the concave part of the first grouting pipe body 1. Then the electric motor is turned off to stop vibration. At the same time, the valve stem 41 is moved to the leftmost side of control valve 42, the hydraulic pipe 37 is pressurized through the hydraulic pump 44, so that liquid pushes a hydraulic lever 36 to rotate clockwise by a certain angle in the hydraulic cylinder 34. As a result, the hydraulic lever 36 drives the grouting hole valve 31 to rotate clockwise until the multiple grouting holes 32 on the grouting hole valve 31 do not overlap with the ports of the slave slurry pipe 53.

The above is only a preferred embodiment of the present invention and not intended to be limiting. Under the inventive concept of the present invention, any equivalent structural transformation made by using the content of the specification and the accompanying drawings of the present invention, or directly/indirectly applied in other related technical fields, are included in the protection scope of the present invention.

What is claimed is:

1. A grouting pipe with a vibration function, comprising: a grouting pipe body provided with a hydraulic control structure, a vibration structure and a grouting hole control structure; wherein the vibration structure is rotatably arranged inside the grouting pipe body, and the hydraulic control structure is provided outside the grouting pipe body; the grouting hole control structure is provided on an internal wall of the grouting pipe body, and the hydraulic control structure is connected to the grouting hole control structure through a hydraulic pipe;

wherein the grouting pipe body comprises a first grouting pipe body and a second grouting pipe body; the first grouting pipe body is connected to the second grouting pipe body by a vibration damping member;

wherein the vibration structure is provided inside the second grouting pipe body, and comprises a drive shaft, a first connection member, a rotating shaft and a second connection member connected in sequence; the drive shaft passes through the first grouting pipe body and is connected to an electric motor; the first connection member and the second connection member are rotatably connected to an internal wall of the second grouting pipe body.

2. The grouting pipe with the vibration function, as recited in claim 1, wherein the first connection member comprises a first support member and a first bearing; the first support member has a hollow structure, and is fixedly connected to the internal wall of the second grouting pipe body; the first bearing is rotatably connected to the first support member.

3. The grouting pipe with the vibration function, as recited in claim 1, wherein an eccentric block is fixed on an external wall of the rotating shaft.

4. The grouting pipe with the vibration function, as recited in claim 1, wherein the grouting hole control structure is provided inside the second grouting pipe body, and comprises a hydraulic lever, a grouting hole valve, a hydraulic cylinder and multiple grouting holes; the grouting hole valve is connected to the hydraulic lever; the hydraulic lever is located inside the hydraulic cylinder; the hydraulic cylinder is connected to the hydraulic control structure through the hydraulic pipe; and the multiple grouting holes are provided on the grouting hole valve.

5. The grouting pipe with the vibration function, as recited in claim 4, wherein a slurry delivery structure is provided inside the grouting pipe body, and comprises a main slurry pipe, a distributor and multiple slave slurry pipes; the main slurry pipe is connected to an external grouting device, and the multiple slave slurry pipes are connected to the multiple grouting holes on the grouting hole valve, respectively.

6. The grouting pipe with the vibration function, as recited in claim 1, wherein an end of the second grouting pipe body, which is away from the first grouting pipe body, is conical.

* * * * *